United States Patent [19]

Kimberlin, Jr.

[11] Patent Number: 4,524,646

[45] Date of Patent: Jun. 25, 1985

[54] TAB CAN OPENING TOOL

[76] Inventor: Fred Kimberlin, Jr., 341 Gallaher Rd., Lebanon, Ohio 45036

[21] Appl. No.: 463,598

[22] Filed: Jun. 2, 1983

[51] Int. Cl.[3] ..... B67B 7/40

[52] U.S. Cl. ..... 81/3.55; 7/901

[58] Field of Search ..... 81/3.46 R, 3.34, 3.36; 7/151, 901

[56] References Cited

U.S. PATENT DOCUMENTS

| | | | |
|---|---|---|---|
| 4,253,352 | 3/1981 | O'Neal | 81/3.46 R |
| 4,257,287 | 3/1981 | Dawson | 81/3.34 |
| 4,309,921 | 1/1982 | Miller | 81/3.46 R |
| 4,371,021 | 2/1983 | Converse et al. | 7/151 |
| 4,373,246 | 2/1983 | Van Houtte et al. | 81/3.46 R |

*Primary Examiner*—Roscoe V. Parker
*Attorney, Agent, or Firm*—Frost & Jacobs

[57] ABSTRACT

A hand-held tool for opening tab open cans. The tool includes an elongated body having an opening with converging surfaces which can be slipped over the tab. A narrow edge at the lower margin of the opening assists initially in lifting the tab away from the can end. As the tool is pivoted upwardly, a chisel-shaped nose portion on the front end of the tool assists in pressing the weakened portion of the can end inwardly. The relationship between the tool nose portion and the thin edge prevents interference between the nose portion and the can end when the tool is initially slipped onto the tab.

19 Claims, 6 Drawing Figures

TAB CAN OPENING TOOL

SUMMARY OF THE INVENTION

The present invention is directed to a hand-held tool for opening beverage cans and the like, and more particularly for opening cans having a lift-up tab.

For environmental reasons, the conventional pull ring type of beverage can opener has been replaced by a lift tab construction which is designed to remain with the can. In this type of construction, the can end is provided with a weakened score line which defines a generally U-shaped portion configured to be broken from the can end and forced by downward pressure into the interior of the can. This produces an oval-shaped opening through which the contents of the can may be dispensed. A generally rectangular shaped tab is hingedly attached to the central portion of the can end by means of a rivet. One end of the tab is provided with a nose which overlies a portion of the U-shaped portion so that when the opposite or terminal end of the tab is lifted away from the can end, the nose is forced downwardly to bend the U-shaped portion into the interior of the can.

Prior to opening, the tab is often pressed tightly against the can end. Consequently, to initially lift the tab away from the can end it is necessary to insert a fingernail or other object between the tab and the can end. Since a fair degree of force must be exerted to cause the tab to break the U-shaped portion from the can end, there is always the danger of breaking a fingernail during the opening process. This risk is considerably increased when a large number of cans must be opened in this manner, which is often the case with workers in commercial taverns and bars.

Prior art workers have suggested ways to overcome this problem. For example, in U.S. Pat. No. 4,253,352 issued Mar. 3, 1981 to G. L. O'Neal, a tool for opening lift tab cans is shown. This tool consists of a sleeve which is dimensioned to fit over the tab. The sleeve can then be lifted, bending the tab upwardly away from the can end. In one embodiment, the sleeve is also provided with a forwardly extending portion which acts to bear against the upper surface of the can within the weakened boundary and assists in opening the can. Such tools have been found helpful in opening certain types of can end constructions. However, it has also been found that there is a lack of uniformity in the dimensions of tab open can ends produced by different manufacturers, particularly in the length of the tab and its relationship to the raised rim which surrounds the can end.

In some instances, it has been found that the length of the tab and its relationship to the can rim prevents the type of tool just described from obtaining a bite or grip on the tab to initially lift it away from the can end. Consequently, the user is forced to pull the tab a slight distance away from the can end surface with a fingernail or the like before the tool can actually be used.

The present invention is intended to provide an improved construction for a tool for opening lift tab cans.

In a preferred embodiment of the invention, the tool comprises a narrow elongated body tapering inwardly and rearwardly to form a graspable handle portion. The forward end of the body forms a chisel-shaped nose portion having a flat front end and rearwardly and outwardly sloping sides. The underside of the tool nose portion includes a surface sloping downwardly and rearwardly.

A fulcrum portion depends downwardly from the body commencing at the rearmost edge of the tool nose surface. The lower surface of the fulcrum portion is configured to abut the can end in order to initially lift the tab away from the can end as the tool is slid onto the tab. The forward end of the fulcrum portion includes an opening dimensioned to accept the outer end of the tab. The floor of the opening includes a first surface sloping upwardly and rearwardly from the forward edge of the lower surface and a second surface of different slope continuing rearwardly from the rear edge of the first surface. The intersection of the first and lower surfaces forms an edge configured to slip between the tab and can end to initially lift the tab away from the can end when the tool is first slid onto the tab.

The tool nose portion extends forwardly from the edge a distance sufficient to permit the edge to be inserted between the tab and can end irrespective of the spacing between the outermost edge of the tab and a can end rim. As a result, the tool of the present invention can obtain a bite or grip on the tab to initially lift it away from the can surface, regardless of the relative spacing of the tab and can rim for the particular can end design.

Further features of the invention will become apparent from the detailed description which follows.

DETAILED DESCRIPTION

Figure 1:
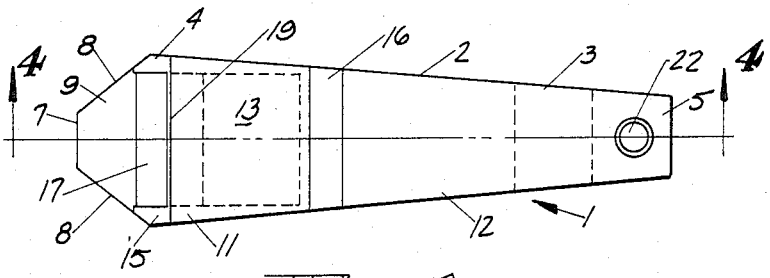
FIG. 1 is a bottom plan view of the tab can opening tool of the present invention.
Figure 2:
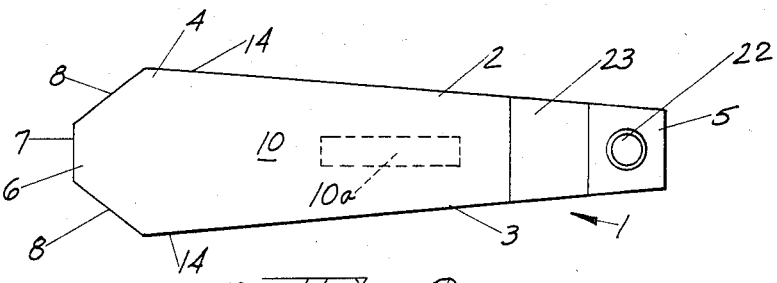
FIG. 2 is a top plan view of the tab can opening tool of the present invention.
Figure 3:
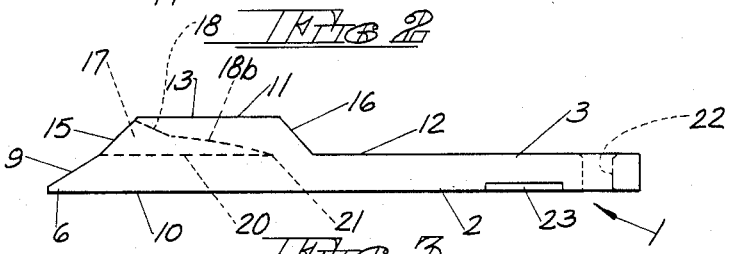
FIG. 3 is an inverted side elevational view of the tab can opening tool of the present invention.
Figure 4:
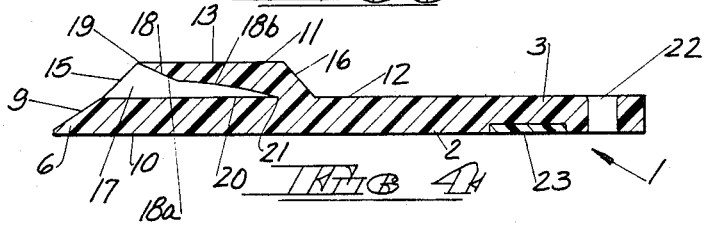
FIG. 4 is an inverted side elevation cross sectional view taken along section line 4—4 of FIG. 1.

The tab can opening tool of the present invention is illustrated generally at 1 in FIG. 1–FIG. 4, where the tool is illustrated in approximately its actual size. Tool 1 is formed from a narrow relatively thin elongated body 2 which tapers inwardly and rearwardly to form a graspable handle portion 3. As can be seen in FIG. 1 and FIG. 2, for example, the widest part of body 2 illustrated at 4 is approximately twice as wide as the narrowest rearward end 5 of the tool. However, other shapes which provide for convenient handling of the tool may also be used.

The forward end of body 2 forms a chisel-shaped nose portion 6 having a flat front end 7 and rearwardly and outwardly sloping sides 8. The width of flat 7 will be dimensioned less than the width of the U-shaped weakened portion of the beverage can as will be explained in more detail hereinafter. The underside of tool nose portion 6 includes a surface 9 which slopes downwardly and rearwardly. Surface 9 will be inclined at an angle of about 30°–60° with respect to the upper surface 10 of the tool, and preferably at an angle of about 45°. As will be explained hereinafter, this angle is important to assist the approach of the tool onto the can tab.

A boss-like fulcrum portion 11 depends downwardly from the lower surface 12 of body 2. The lower surface 13 of fulcrum portion 11 is substantially flat and configured to abut and slide along the upper surface of the can end as the tool is initially slid onto the can tab. The sides 14 of fulcrum portion 11 are substantially coplanar with the side edges of body 2. The front edge of fulcrum portion 11 slopes downwardly and rearwardly as at 15. The rear edge 16 of fulcrum portion 11 slopes forwardly and downwardly and enables the fulcrum portion to clear the edge of the can end rim when the tool is in use. In general, the length of fulcrum position 11 will be less than the distance between the connection point of the tab to the can end and the can rim.

The fulcrum portion 11 is provided with an opening or interior cavity 17 which extends rearwardly a distance approximately three quarters the length of the fulcrum portion. In general, cavity 17 will be of sufficient depth to accept the entire length of the can tab. The forwardmost part of opening 17 is dimensioned to easily accept the outer end of the tab when the upper surface 10 of the tool is oriented parallel to the can end. The lower surface of opening 17 forms a floor 18 which includes a first surface 18*a* sloping upwardly and rearwardly from the lower edge of opening 17 at an angle of about 45–70°, with an angle of 60° being preferred. It will be observed that first surface 18*a* and lower surface 13 intersect to form a sharp edge 19 along the bottom of opening 17. Edge 19 is relatively thin so as to easily slip between the tab and can end to initially lift the tab away from the can end when the tab is inserted in opening 17 as will be described in more detail hereinafter. Guiding of the tab into opening 17 is accomplished by sloping surfaces 18*a*.

A second surface 18*b* extends rearwardly from the rear edge of surface 18*a* at a somewhat shallower angle, and intersects the rear edge of the roof portion 20 of opening or cavity 17 as at 21. The spacing between surface 18*a* and roof portion 20 operates to hold the tab in place when the tool is slipped over the tab and pivoted upwardly.

Tool 1 may be fabricated from any suitable durable material such as plastic or the like and may be made in various colors. The tool may be molded in one piece, or may be assembled from separately machined or molded pieces. An aperture 22 is provided at the rearward end 5 for hanging tool 1 from a suitable hook or the like. In addition, the upper surface 12 may be provided with a magnet 23 which can be used to temporarily affix the tool to a metallic support such as a cabinet or the like. Advertising or other indicia may be placed on the upper surface of the tool, as at !O*a*, for example.

Figure 5:
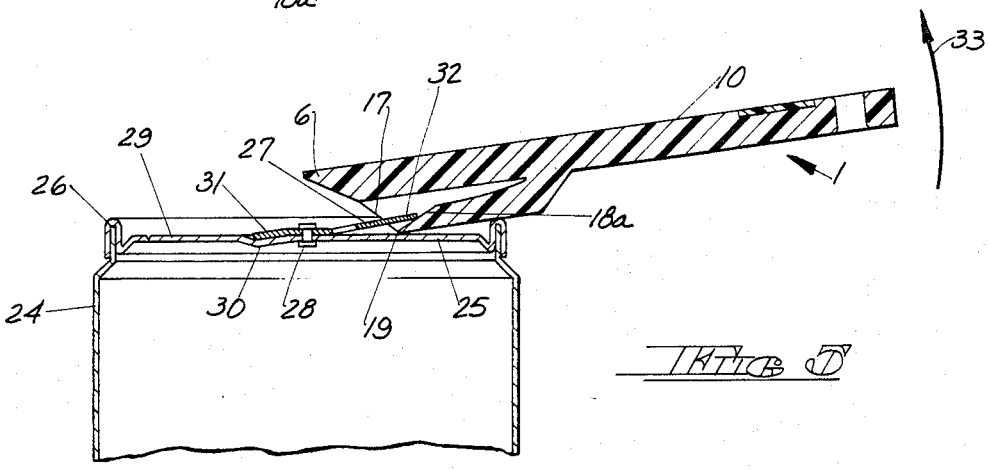
FIG. 5 is a fragmentary cross sectional view illustrating the tab can opening tool of the present invention initially applied to a conventional tab open can.
Figure 6:
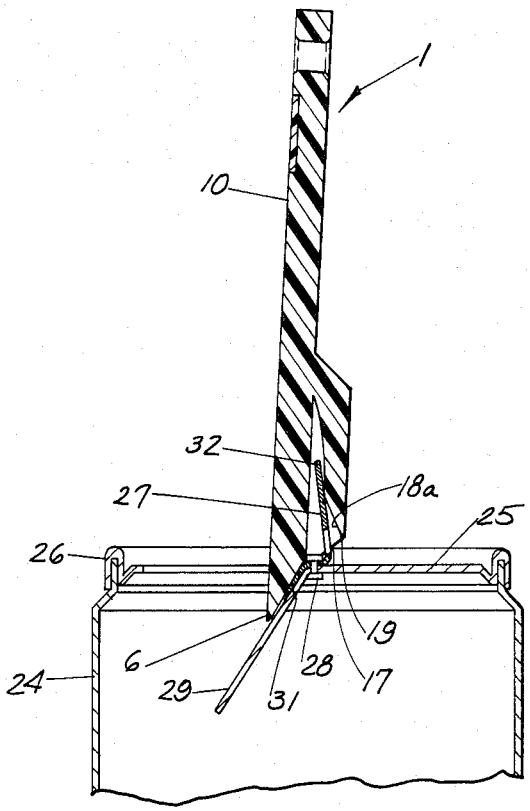
FIG. 6 is a fragmentary cross-sectional view illustrating the tab can opening tool of the present invention pivoted to a postion to open the tab open can.

The use and operation of the tab opening tool of the present invention is illustrated in FIG. 5 and FIG. 6. A typical metallic beverage can 24 is illustrated having a relatively planar upper can end 25 surrounded by an upstanding annular lip 26. A generally rectangular tab 27 is secured to the center of can end 25 by a rivet 28 or the like. The generally U-shaped portion 29 is defined by a weakened score line 30 and is configured to be broken from the can end and forced by downward pressure into the interior can as is well known in the art. Tab 27 includes a nose portion 31 which overlies a portion of U-shaped portion 29 so that when the terminal end 32 of the tab is lifted away from the can end, the nose is forced downwardly to bend the U-shaped portion into the interior of the can.

To use the opening tool 1 of the present invention, the tool is oriented so that planar surface 10 faces upwardly. Edge 19 of the tool is then slipped between the lower surface of tab 27 and the upper surface of can end 25 so as to slightly lift the tab. The angled surfaces 9 and 18*a* of the tool assist in guiding the edge of the tab into opening 17 as the tool is slipped over the tab. It will be observed that the nose portion 6 of the tool extends forwardly from edge 19 a distance sufficient to permit edge 19 to be inserted between the tab and can end irrespective of the spacing between the outermost edge of the tab and the can end rim. In other words, edge 19 which facilitates the initial lifting of the tab is recessed behind nose portion 6 of the tool to prevent interference between the tool nose portion and any part of the can end structure.

Forward pressure is then applied to the tool so that the tab slips smoothly into cavity 17. At the same time, the tool may be pivoted in the direction of arrow 33 to the ultimate position illustrated in FIG. 5. It will be observed that as the tool is pivoted, the nose portion of the tool operates to press downwardly and inwardly against the upper surface of U-shaped portion 29 of the can end, thereby helping to break the U-shaped portion along the weakened score line and bend the U-shaped portion inwardly into the interior of the can. At the same time, the pivotal movement operates to bend the tab upwardly away from the can end so that the nose portion of the tab also assists in pressing the U-shaped portion inwardly. As shown in FIG. 6, all of the tab lies within cavity 17 so that the tab is supported along its length, thereby preventing concentration of stress at intermediate points along the tab which might cause it to break off.

After the can end has been opened, the tool may be slid from the tab, and stored in a suitable location by means of either aperture 22 or magnet 23. It will be observed that the tool is devoid of sharp edges so that it may be carried in a pocket.

It will be understood that various changes in the details, steps, materials and arrangements of parts, which have been herein described and illustrated in order to explain the nature of the invention may be made by those skilled in the art within the principle and scope of the invention as expressed in the appended claims.

The embodiments of the invention in which an exclusive property or privilege is claimed are as follows:

1. A hand-held tool for opening beverage cans and the like of the type having an end including a circumferentially extending upstanding rim and a weakened score line defining a generally U-shaped portion configured to be broken from the can end and forced by downward pressure into the interior of the can and a tab hingedly attached to the central portion of the can end including a nose portion overlying a portion of the U-shaped portion such that when the terminal end of the tab is lifted away from the can end, the nose is forced downwardly to bend the U-shaped portion into the interior of the can, said tool comprising a thin narrow elongated body terminating at one end in a graspable handle portion and at the opposite end in an opening dimensioned to be slipped over the can end tab and retain the tab when the tool is pivoted upwardly away from the can end, the lower margin of said opening forming a transversely extending sharp thin edge configured to easily slip between the tab and upper surface of the can end to initially lift the tab away from the can end, and a nose portion extending forwardly from and overlying said opening, said tool nose portion being configured to and extending forward a distance so as to press downwardly on the U-shaped portion of the can end when the tool is slipped over the can tab and pivoted upwardly to force the U-shaped portion into the interior of the can, said tool nose portion and said edge being positioned with respect to each other such that said tool nose portion remains out of contact with said can end when said edge is intially inserted between the tab and can end surface in order to insure that the edge can be initially slipped beneath the tab regardless of the spacing between the outermost end of the tab and the can rim, the underside of said tool nose portion including a nose surface sloping downwardly and rearwardly; a fulcrum portion depending downwardly from said body commencing at the rearmost edge of said surface, the lower surface of said fulcrum portion being configured to abut the upper surface of the can end, the forward end of said fulcrum portion including said opening, the floor of said opening including a first surface sloping upwardly and rearwardly away from the forward edge of said lower surface and a surface spaced from said lower surface continuing rearwardly from the rear edge of said first surface, the intersection of said first and lower surfaces forming said edge, said nose surface being configured to insure access to and guide the tab into said opening irrespective of the spacing between the outermost edge of the tab and the can end rim, said second surface continuing upwardly and rearwardly at a lesser slope from the rearmost edge of said first surface, the space between said first and second surfaces and a roof surface forming an opening of decreasing height such that a portion at least of the spacing between said nose and second surfaces is less than the thickness of the tab, said edge operating to initially lift the tab away from the can end when the tab is inserted into said opening, said first surface operating to further lift the tab and guide it into the space between said second and nose surfaces, the tab becoming wedged between said second and nose surfaces to prevent the tab from becoming disengaged from the tool as the tool is rotated upwardly to lift the tab.

2. The tool according to claim 1 wherein said tool is fabricated from a tough durable plastic material.

3. The tool according to claim 1 including magnet means secured to the tool for temporarily attaching the tool to a metallic surface.

4. The tool according to claim 1 wherein said body tapers rearwardly and inwardly.

5. The tool according to claim 1 wherein said tool nose portion is chisel-shaped and includes a flat front end and rearwardly and outwardly sloping sides.

6. The tool according to claim 1 wherein the underside of said tool nose portion slopes downwardly and rearwardly at an angle of about 30°-60°.

7. The tool according to claim 1 wherein the underside of said tool nose portion slopes downwardly and rearwardly at an angle of about 45°.

8. The tool according to claim 1 wherein said first surface slopes upwardly and rearwardly at an angle of about 45 °-70 °.

9. The tool according to claim 1, wherein said first surface slopes upwardly and rearwardly at an angle of about 60°.

10. The tool according to claim 1 wherein said nose surface slopes downwardly and rearwardly at an angle of about 30°-60°,and wherein said first surface slopes upwardly and rearwardly at an angle of about 45°-70°.

11. A hand-held tool for opening beverage cans and the like of the type having an end including a circumferentially extending upstanding rim and a weakened score line defining a generally U-shaped portion configured to be broken from the can end and forced by downward pressure into the interior of the can and a tab hingedly attached to the central portion of the can end including a nose portion overlying a portion of said U-shaped portion such that when the terminal end of the tab is lifted away from the can end, the nose is forced downwardly to bend the U-shaped portion into the interior of the can, said tool comprising an elongated body terminating at its rearward end in a graspable handle portion and at its opposite forward end in means for engaging the tab, said means comprising a tool nose portion formed in the forward end of said body configured to press downwardly on the U-shaped portion of the can end when the handle portion of the tool is pivoted upwardly to force the U-shaped portion into the interior of the can, the underside of said nose portion continuing rearwardly to form a nose surface; a lower surface spaced rearwardly of and below said tool nose surface and configured to abut the upper surface of the can end; a first surface extending rearwardly and upwardly from the forward edge of said lower surface, the intersection of said lower and first surfaces forming a thin edge configured to slip between the tab and can end to initially lift the tab away from the can end; said tool nose portion being positioned with respect to said edge to permit the edge to be inserted between the tab and can end irrespective of the spacing between the outermost edge of the tab and the can end rim, and a second surface continuing upwardly and rearwardly at a lesser slope from the rearmost edge of said first surface, the space between said first and second surfaces and a roof surface forming an opening of decreasing height such that a portion at least of the spacing between said nose and second surfaces is less than the thickness of the tab, said edge operating to initially lift the tab away from the can end when the tab is inserted into said opening, said first surface operating to further lift the tab and guide it into the space between said second end nose surfaces, the tab becoming wedged between said second end nose surfaces to prevent the tab from becoming disengaged from the tool as the tool is rotated upwardly to lift the tab.

12. The tool according to claim 11 wherein the underside of said tool nose portion slopes downwardly and rearwardly at an angle of about 30°-60°.

13. The tool according to claim 11 wherein the underside of said tool nose portion slopes downwardly and rearwardly at an angle of about 45°.

14. The tool according to claim 11 wherein said first surface slopes upwardly and rearwardly at an angle of about 45°-70°.

15. The tool according to claim 11 wherein said first surface slopes upwardly and rearwardly at an angle of about 60°.

16. The tool according to claim 11 wherein the underside of said tool nose portion slopes downwardly and rearwardly at an angle of about 45° and said first surface slopes upwardly and rearwardly at an angle of about 60°.

17. The tool according to claim 16 wherein said tool nose portion is chisel-shaped and includes a flat front end and rearwardly and outwardly sloping sides.

18. The tool according to claim 17 wherein said boy tapers rearwardly and inwardly.

19. The tool according to claim 18 wherein said tool is fabricated from a tough durable plastic material and includes magnet means secured to the tool for temporarily attaching the tool to a metallic surface.

* * * * *